US006579091B1

(12) United States Patent
Simonen

(10) Patent No.: US 6,579,091 B1
(45) Date of Patent: Jun. 17, 2003

(54) CLEANING DEVICE FOR CLEANING AIR PORTS OF A FURNACE

(75) Inventor: Jorma Simonen, Alpharetta, GA (US)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 10/092,422

(22) Filed: Mar. 7, 2002

Related U.S. Application Data

(60) Provisional application No. 60/346,618, filed on Jan. 10, 2002.

(51) Int. Cl.[7] ..... B08B 1/00

(52) U.S. Cl. ..... 432/75; 432/2; 15/104.16

(58) Field of Search ..... 432/2, 64, 75, 432/149, 150, 194, 198, 201; 122/379; 15/104.16, 104.5, 104.061

(56) References Cited

U.S. PATENT DOCUMENTS 4,822,428 A * 4/1989 Goodspeed ..... 122/379
4,872,834 A * 10/1989 Williams, Jr. ..... 432/75
4,907,543 A * 3/1990 Matranga et al. ..... 432/75
6,431,125 B1 * 8/2002 Eriksson ..... 432/75

* cited by examiner

*Primary Examiner*—Gregory Wilson
(74) *Attorney, Agent, or Firm*—Nixon & Vanderhye P.C.

(57) ABSTRACT

A cleaning device is disclosed for cleaning an air port in a wall of a furnace having an air register adjacent to the air port outside of the wall of the furnace, the cleaning device comprising: a cleaning head having a substantially-open, cross-sectional shape conforming to a cross-sectional shape of the air port, said clean head moving reciprocally in and out of the air port, and a head support extending from the cleaning head, through the air register and attached to an actuator, said actuator reciprocally moving the head support, and said head support having perforated walls permitting to flow through the walls.

9 Claims, 2 Drawing Sheets

CLEANING DEVICE FOR CLEANING AIR PORTS OF A FURNACE

RELATED APPLICATION

This application claims priority to U.S. provisional application 60/346,618 filed Jan. 10, 2002.

FIELD OF INVENTION

The present invention relates to a device for cleaning air ports of a furnace, especially a furnace of a chemical recovery boiler.

BACKGROUND AND SUMMARY OF INVENTION

Black liquor obtained during the production of pulp is combusted in a soda recovery boiler for recovering chemicals and producing energy. The burning of organic material contained in the black liquor requires an abundant amount of air to ensure as complete combustion as possible and maintain a high process efficiency. Air is fed into the furnace of the boiler through air ports located in the wall of the furnace. The ports are conventionally laid out in horizontal rows located at several elevations up the furnace. The ports in the wall are usually provided with nozzles which direct the air into the furnace. The air is fed into the air ports from air ducts surrounding the furnace via wind boxes or the like. Usually, the air is introduced into the furnace through at least three elevational levels of the furnace. Air ports in the furnace wall are generally provided at each level. Typically, the lowest air port level is a primary air level, the middle air port level is a secondary air level, and the uppermost air port level is a tertiary air level. Nozzles for injecting the liquid liquor may be arranged between the secondary and tertiary air port level. More than three air port levels for introducing air into the furnace may be arranged in the boiler.

Liquor and other liquid or slurry solutions flow from the walls of the boiler to the edge of the air ports on the side of the furnace. On the inside surface of the furnace walls, the solutions solidify and tend to plug the air ports. The airflow being fed via the ports into the furnace is not capable alone of keeping the ports clear of these deposits. The air ports must frequently be freed of any built-up excrescent material by rodding, a known cleaning technique to repeatedly insert a cleaning rod (or rodder) into the air port to dislodge the build up of material and thereby ensure adequate airflow into the boiler. Rodding can be either manual or automatic.

Some air port cleaning devices are provided with a cleaning head, which reciprocates in and out of the air ports during the cleaning. These cleaning heads remove slag, e.g., deposits, from the air ports. Adjacent to the air port there is a damping plate for regulating the volume of airflow being introduced into the furnace. The cleaning head can interfere with the operation of the damper. The cross-sectional area of the sleeve-like cleaning head is somewhat smaller than the cross-sectional area of the air nozzle. Usually, the cleaning head is connected with a rod to an actuator, such as a pneumatic or hydraulic cylinder. The actuator effects the reciprocating motion of the cleaning sleeve. The cylinder of the actuator is located outside the air register. The cylinder is connected to a long rod that extends through the air register to connect to the cleaning head. Usually, the damper of the register is moved to its extreme position during the use of the cleaning sleeve to avoid disturbing the motion of the rod of the cylinder. This repositioning of the damper during cleaning causes disturbances in the airflow pattern flowing into the air port and further into the furnace, and results in undesirable boiler operation.

There is a long-felt need in the field of furnaces, especially those in chemical recovery boilers, to provide a cleaning device for air ports that eliminates or reduces the problems discussed above. It would be beneficial to have a cleaning device that efficiently removes deposits from an air port without interfering with the on-going airflow into the furnace. It would also be beneficial for the cleaning device to have an open construction to allow air to cool the cleaning device and air register adjacent to the air port. The cleaning device is further preferably devoid of elements that might disturb the airflow through the register, air port and into the furnace.

A sleeve-like or annular cleaning head has been developed which reciprocally slides into an air port and fits into a lower section of an air register. The cleaning device has a cleaning head with a cross-sectional shape that is similar to the cross-sectional shape of an air port. The cleaning head is attached to an elongated head support having a cross-sectional shape similar to a lower portion of the air register. The cleaning head is adapted to slide back and forth into the air port, and thereby dislodge debris from the port. Actuating members are operationally connected to an opposite end of the head support for reciprocally moving the cleaning head in the air port. The walls of the cleaning head and head support are provided with holes to allow air to flow through and cool the walls of the cleaning device.

In one embodiment, the invention is a cleaning device for cleaning an air port in a wall of a furnace having an air register adjacent to an air port in an outside of the wall of the furnace. The cleaning device comprises: a cleaning head having a substantially-open, cross-sectional shape conforming to a cross-sectional shape of the air port, said clean head moving reciprocally in and out of the air port, and a head support extending from the cleaning head, through the air register and attached to an actuator, said actuator reciprocally moving the head support, and said head support having perforated walls permitting air to flow through the walls.

The cleaning device is especially suitable for cleaning secondary and tertiary air ports of a furnace in a recovery boiler. It may also be used for cleaning other air ports, especially in the upper part of a furnace. The cleaning device is especially suitable for use with air registers, wherein the flow direction of the air changes essentially as the air arrives from a wind box or the like into the air register. As the air enters and passes through an air register, the flow turns typically 90° (±20°) in relation to its inflow direction.

BRIEF DESCRIPTION OF THE DRAWINGS

The present invention is described in more detail with reference to the accompanying figures, of which.

DETAILED DESCRIPTION OF THE INVENTION

Figure 1:
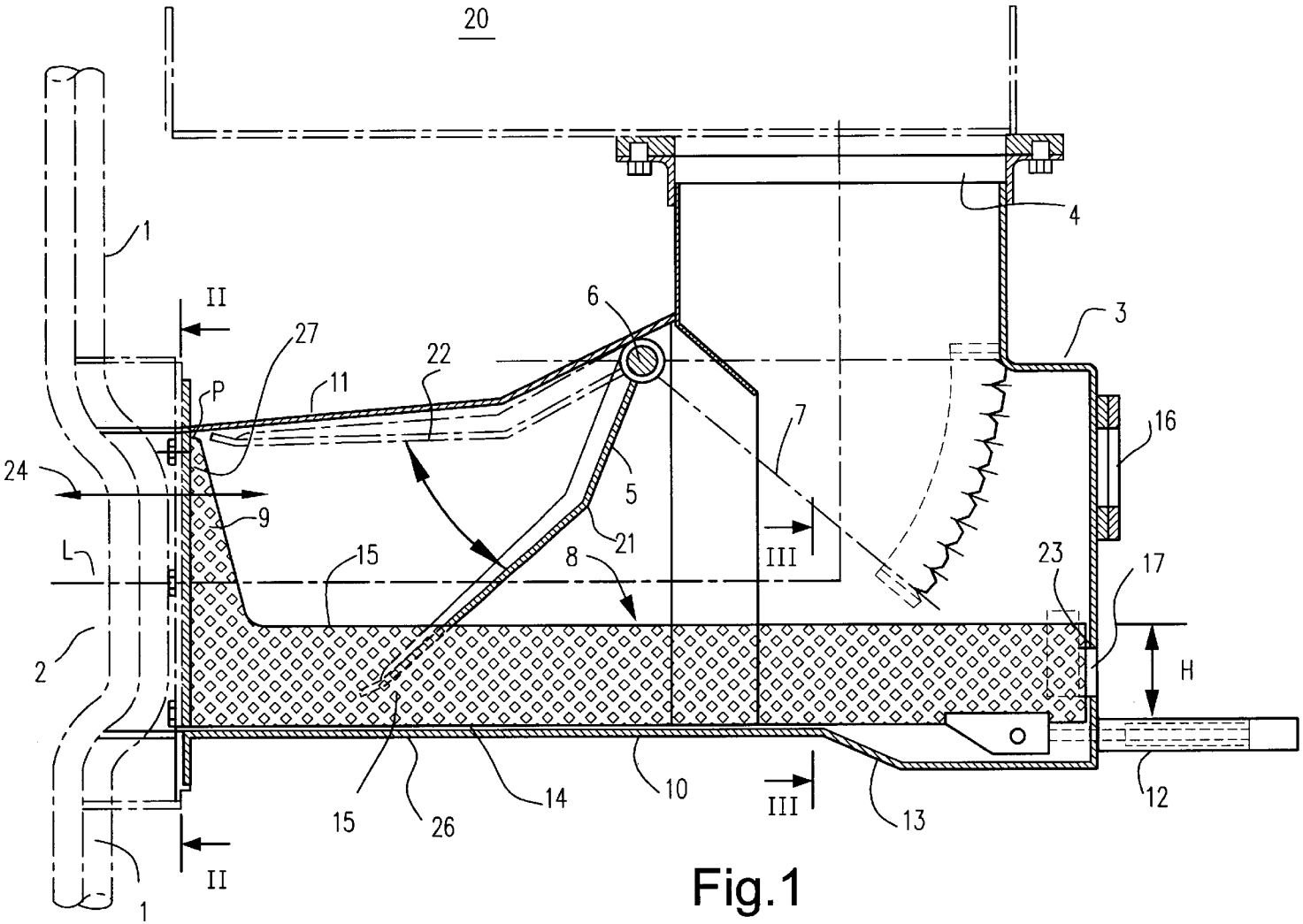
FIG. 1 is a schematic side view of an air port cleaning device for air ports in a furnace.

FIG. 1 illustrates a furnace wall formed of water-cooled tubes 1. The furnace may be a recover furnace of a chemical recovery boiler. At certain points along the wall, adjacent tubes are bent apart to form air ports 2 between the tubes. These ports are usually provided with nozzles for directing the air into the furnace. The air flows generally in the direction of "L" (which is perpendicular to the furnace wall) through the air ports and into the furnace. In a typical recovery furnace, the airflow direction changes as it approaches the ports in the furnace wall. The flow changes may be due to the geometry of the flow path leading to the air port, such as occurs when a wind box and air register are at different levels.

Air is fed into the air port (see gap 2) from an air register 3. The air register for each port may be an air chute aligned with the port and extending outward from the furnace wall. The air flows into the register 3 via a passage 4 from a wind box 20. The air register is provided with an airflow regulating device, such as a damper plate 5. The regulating device controls the airflow through the register to the air port. The damper plate turns about a shaft 6. The angular position of the damper plate is set by the position of a control lever 7 located outside the air register. The regulation device may have a construction different from the damper plate presented herein.

Air entering the air register via passage 4 flows towards and under the lower edge of the damper plate S and further into the air port 2. As the air passes from the passage 4 and into the register 3, the flow of air may turn ninety degrees, plus or minus 20 degrees. In FIG. 1 the damper plate 5 is shown in a near-closed position 21 and, thus, the airflow through the register 3 and into the furnace is minimized. The damper plate 5 is also shown in dotted lines in position 22 as being completely open when placed almost against an upper edge 11 of the air register. In the open position, the damper plate allows a maximum airflow through the register and into the air port.

Figure 4:
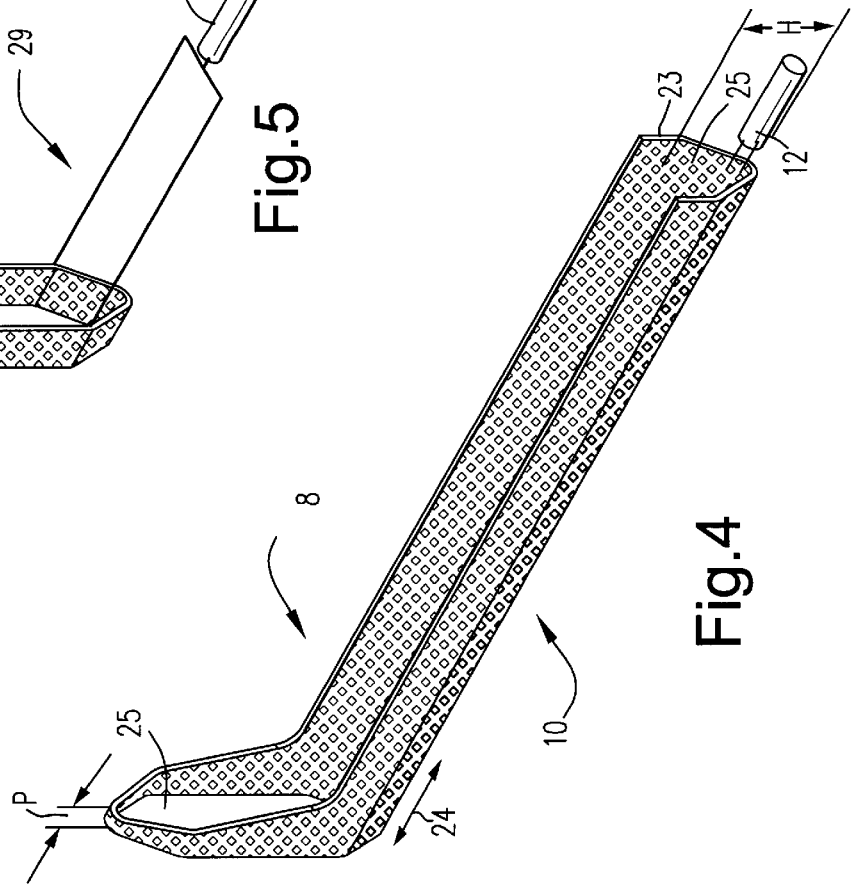
FIG. 4 is a schematic perspective view of the cleaning device.

The air register 3 is further provided with a cleaning device 8 for cleaning the air ports 2. FIG. 4 shows a perspective view of an exemplary cleaning device 8. The cleaning device comprises a cleaning head 9 and an elongated head support 10. The head and head support may be integral and formed of a single plate. Alternatively, the head may be separate from, but attached to the head support.

The cleaning device fits in the air register. The head support is seated in the lower portion of the air register. In the longitudinal direction, the head support 10 extends at least partially along the bottom of the air register 3. At its rear end 23, i.e., the end opposite the air port, the head support is connected to an actuating member 12, which reciprocally (see arrow 24) moves the head support 10 and the cleaning head 9 within the air register and air port. The actuating member 12 may preferably be a pneumatic cylinder, such as an air cylinder or a hydraulic cylinder. The actuating member is preferably located outside the air register 3.

Figure 2:
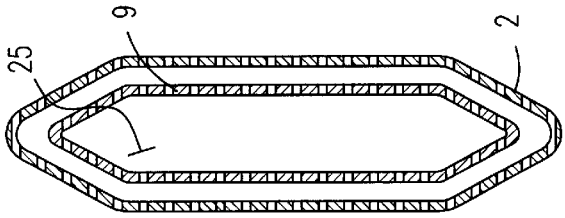
FIG. 2 is a schematic section along lines A—A of FIG. 1 of the cleaning device.

As shown in FIG. 2, the cleaning head 9 is a sleeve that fits snugly inside the air port. The cleaning head has a cross-sectional shape substantially corresponding to the cross section of the air port 2. But, the cross-sectional dimensions of the cleaning head are somewhat smaller than the air port. The cleaning head slides reciprocally into the air port. The cleaning head 9 is also annular and open 25 at its fore and rear ends to allow air to pass through the head without substantial disruption of the airflow. The cross-sectional shape of the air port (and hence the cleaning head) may be rectangular, polygonal, elongated or some other shape.

The reciprocal motion 24 of the cleaning head 9 removes deposits accumulated on the air port. These deposits, if allowed to accumulate, would plug the air port and prevent the desired flow of air into the furnace. The reciprocating strokes of the cleaning head in the air port 2 are performed periodically to clean the air port. Between the cleaning strokes (see arrow 24), the cleaning head is pulled out of the air port so that it is at rest adjacent the air port and sitting in the air register. The cleaning head and head support lie dormant in the air register 3 while the head is not cleaning the air port. While dormant in the air register, the cleaning head and support do not obstruct airflow through the register and into the air port.

The actuating member 12 is preferably fixed directly to the end 23 of the support head 10. There need be no transmission bar between the actuating member and the support head. Eliminating a transmission bar reduces the length of the cleaning device and the number of components associated with the cleaning device. A connector (e.g., transmission bar) may be adapted between the supporting part and the actuating member, but a connector may increase the length of the cleaning device.

The actuating member 12 is positioned near the bottom of the air register. An inspection glass 16 and a cleaning conduit 17 may be located in the end of the air register for possible cleaning effected by manual rodding. A cleaning rod may be inserted into the conduit 17, and used to remove air port deposits and debris that have accumulated in the cleaning head 9.

The bottom 26 of the air register has a recess 13 having an inclined edge on the side of the furnace. During the cleaning strokes, some deposits dislodged from the air port may fall into the cleaning device and further into the recess 13 in the bottom of the air register. The reciprocal movement of the cleaning device will gradually transfer the deposits towards the furnace. The deposits climb up the inclined edge of the recess, and the airflow through the air register finally carries them away to the furnace. The recess 13 may be added to an existing air register in connection with retrofitting the new cleaning device 8 to an existing air register.

Figure 3:
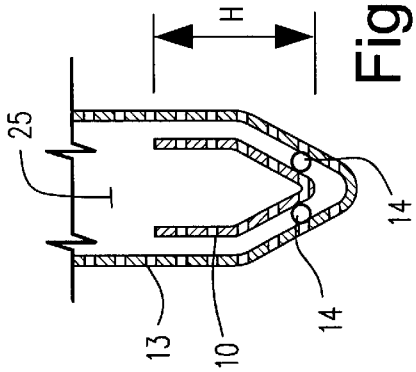
FIG. 3 is a schematic section along lines B—B of FIG. 1 of the cleaning device.

In the embodiment of FIG. 1, the cleaning head 9 and the head support 10 are made of a perforated plate which is a contiguous piece of metal. The perforated plate is formed into the chute-like construction of the cleaning member 10, as shown in cross-section in FIG. 3 and in perspective view in FIG. 4. The perforations in the walls of the cleaning device may be machined from plate, for example, by water-jet cutting, laser cutting, drilling, milling, or any other conventional method of producing apertures in plate.

The head support 10 is supported on sliding supports 14 between the head support and the bottom.26 of the air register 3. The supports 14 guide the reciprocating motion of the cleaning device as the actuating member 12 pushes the cleaning head into and out of the air port during the cleaning strokes.

Due to its chute-like shape, the head support and cleaning head do not disturb the movement of the damper plate 5. The damper plate can swing in and out of the head support 10, without bumping into the reciprocating cleaning device 8. There is no need to adjust the damper plate to make way for the cleaning device when it reciprocates in the air port. Further, the cleaning device is devoid of obstacles, which might hamper the airflow into the furnace in the direction of the longitudinal axis L of the air register.

The height H of the head support 10 in the air register 3 is less than the height of the air port, and may preferably be less than half of the height of the air port 2. On the side of the air port, the upper edge 27 of the head of the cleaning device forms a wedge-shaped end extending upwards and forming an annular sleeve. This wedge-shaped end is part of the cleaning head 9. The length P (parallel to line "L" in FIG. 1) of the upper part 27 of the cleaning head is typically 1–5 centimeters (cm), and is preferably 1–3 cm.

The walls of the cleaning head 9 and head support 10 are perforated with holes 15. High velocity air is permitted to flow through the peforated walls to cool the cleaning device 18. The air flowing through the perforations also assists cleaning the walls of the cleaning device. Preferably, both the cleaning head 9 and the head support 10 are perforated to permit airflow through the walls of the cleaning device. As the cleaning head reciprocates through the air port, air jetting through the walls of the cleaning head blast at the inner surface of the air port and thereby enhance the cleaning of the air ports. Various formations, cross-sectional shapes and dimensions of the openings can be employed as long as there is an adequate flow of air through the openings is reached.

The cleaning device 8 may be formed of a perforated plate essentially in the form of a contiguous piece. The device may alternatively be formed of two plates fixed to each other. The cleaning head 9 may also be formed of a non-perforated plate fixed to a supporting part made of perforated plate. The head support 10 may also be fashioned from bars oriented parallel to the direction "L" so that the air passes through vertical slots or apertures between the bars.

The cleaning device 10 provides several advantages including (without limitation): (i) the cleaning device does not substantially disturb the flow of air in the air nozzle and does not require regulation of the damper plate during the cleaning; (ii) the length of a cleaning stroke and the length of the actuating member are minimized, but the cleaning member still does not significantly disturb the airflow through the air register and into the air port and the actuating member is conveniently situated outside the air register; (iii) automated regulation of the damper plate during cleaning is facilitated, as the motion of the cleaning head does not require an adjustment of the damper position; (iv) the chute-like construction of the cleaning device is rigid; (v) the construction material used to form the cleaning device, such as a perforated plate, minimizes thermal deformation, and (vi) perforations in its walls makes the device self-cleaning, as air flows through its perforated walls and cleans the cleaning device both from the outside and from the inside.

Figure 5:
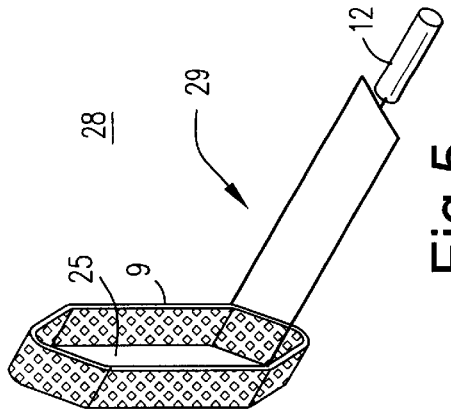
FIG. 5 is a schematic perspective view of a second embodiment of the cleaning device.

FIG. 5 is a schematic perspective illustration of a second embodiment of a cleaning head 28 that includes a cleaning head similar to the cleaning head on the first embodiment of the cleaning device 8. Instead of a head support chute formed of perforated plate, the second embodiment has multiple bars 29 that extends from the cleaning head, along the length of the air register and connects to a reciprocating actuator 12.

The preferred embodiment of the invention now known to the invention has been fully described here in sufficient detail such that one of ordinary skill in the art is able to make and use the invention using no more than routine experimentation. The embodiments disclosed herein are not all of the possible embodiments of the invention. Other embodiments of the invention that are within the spirit and scope of the claims are also covered by this patent.

What is claimed is:

1. A cleaning device for cleaning an air port in a wall of a furnace having an air register adjacent to the air port outside of the wall of the furnace, the cleaning device comprising:

a cleaning head having a substantially open cross-sectional shape conforming to a cross-sectional shape of the air port, said clean head moving reciprocally in and out of the air port, and a head support extending from the cleaning head, through the air register and attached to an actuator, said actuator reciprocally moving the head support, and said head support having an airflow passage and perforated walls permitting air to flow through the walls.

2. A cleaning device according to claim 1 wherein the cleaning head has a first position where the cleaning head moves reciprocally in the air port, and a second position in where the cleaning head is retracted from the air port and sits in the air register.

3. A cleaning device for cleaning an air port in a wall of a furnace having an air register adjacent to the air port outside of the wall of the furnace, the cleaning device comprising:

a cleaning head having a substantially open cross-sectional shape conforming to a cross-sectional shape of the air port, said clean head moving reciprocally in and out of the air port, and a head support extending from the cleaning head, through the air register and attached to an actuator, said actuator reciprocally moving the head support, and said head support having perforated walls permitting air to flow through the walls, wherein the head support has a chute shape.

4. A cleaning device according to claim 3, wherein the cleaning head is perforated to allow air to flow through the head.

5. A cleaning device according to claim 4, wherein the cleaning head and a head support are formed from a perforated plate.

6. A cleaning device according to claim 5, wherein the cleaning head and the head support are formed of a contiguous perforated plate.

7. A cleaning device according to claim 3, wherein the head support is formed of bars extending between the cleaning head and actuator.

8. A cleaning device according to claim 3, further comprising sliding supports between the head support and a lower surface of the air register.

9. A cleaning device according to claim 3, wherein a height of the head support is no greater than one-half of a height of the air port.

* * * * *